US006719291B1

(12) United States Patent
deKeller

(10) Patent No.: US 6,719,291 B1
(45) **Date of Patent: *Apr. 13, 2004**

(54) METHOD AND SYSTEM FOR PLAYING A CASINO GAME

(76) Inventor: David deKeller, Sweet Valley Farm, Cape Town (ZA)

( * ) Notice: Subject to any disclaimer, the term of this patent is extended or adjusted under 35 U.S.C. 154(b) by 0 days.

This patent is subject to a terminal disclaimer.

(21) Appl. No.: 09/653,048

(22) Filed: Sep. 1, 2000

Related U.S. Application Data

(63) Continuation-in-part of application No. 09/396,659, filed on Sep. 15, 1999, now abandoned, and a continuation-in-part of application No. 09/316,705, filed on May 21, 1999, now Pat. No. 6,279,910, which is a continuation-in-part of application No. 09/239,175, filed on Jan. 28, 1999, now Pat. No. 6,283,474.

(51) Int. Cl.[7] ..... A63F 1/00
(52) U.S. Cl. ..... 273/274; 273/292; 463/26
(58) Field of Search ..... 273/274, 292, 273/303; 463/13, 26, 27, 12; D21/334, 354, 369; 434/128

(56) References Cited

U.S. PATENT DOCUMENTS 5,395,120 A * 3/1995 Malek ..... 273/292
5,577,731 A * 11/1996 Jones ..... 273/292
6,467,771 B1 * 10/2002 deKeller ..... 273/274

* cited by examiner

*Primary Examiner*—V K Mendiratta
(74) *Attorney, Agent, or Firm*—Philip J. Anderson; Anderson & Morishita, LLC

(57) ABSTRACT

A method and system are set forth for playing a casino game of the type where each player has a hand and competes against a hand of the dealer and or against other players using a communal holding. Each player wagers to participate in the game and posts an additional pot wager, said pot wagers aggregated to form a pot. The underlying game is played according to its established rules. The pot wagers are determined by comparing the players hands inter se to determine which player has the highest ranked holding, also according to the rules of the game. For certain dealer hands or communal holdings, the dealer wins the pot. No commission or levy is made against the pot by the casino. The system provides interlinked games to practice the method.

5 Claims, 4 Drawing Sheets

3 X 4'S SUITED = PROGRESSIVE JACKPOT

3 X 4'S UNSUITED = MINOR JACKPOT

2 X 4'S SUITED = $ 100

2 X 4'S UNSUITED = $ 50

METHOD AND SYSTEM FOR PLAYING A CASINO GAME

CROSS-REFERENCE TO RELATED APPLICATION

The present application is a Continuation-in-Part application of application Ser. No. 09/316,705 filed May 21, 1999 titled "Method for Playing a Casino Game" now U.S. Pat. No. 6,279,910 which is a continuation-in-part of application Ser. No. 09/239,175 filed Jan. 28, 1999 by the applicant herein and also titled "Method for Playing a Casino Game" now U.S. Pat. No. 6,283,479 and the present application is a continuation-in-part of Ser. No. 09/396,659 filed Sep. 15, 1999 and titled "Improved Method fo Playing a Card Game" now abandoned.

FIELD OF THE INVENTION

The present invention relates to methods for playing casino games using playing cards. More particularly it relates to casino games such as Blackjack, Blackjack-like, Baccarat games, Poker and Poker dice related games .

BACKGROUND

Blackjack, also known as "21" is popular and has been played in casinos for many years. The rules of the game of Blackjack are well known to those skilled in the art.

The rules, with a few exceptions, are fairly universal. Some alternate rules of the basic Blackjack game require the dealer to hit a soft 17 (a hand count according to the rules of Blackjack of 17 including an Ace which counts as one or eleven), limit the hand counts to which a player can double down to ten or eleven, and limit the number of times a hand can be split are but a few examples. These alternate or modified rules are well known as well.

Recently, Blackjack-like games such as SPANISH 21® described in U.S. Pat. No. 5,615,888 issued Apr. 1, 1997 to Lofink et al the disclosure of which is hereby incorporated by reference, have been created. Some of these games include the feature of an additional or side wager to fund and participate in a jackpot feature for the game based upon the player's hand. In these games the side wager is optional and is not mandatory As hereinafter used, the term Blackjack or Blackjack-like or Blackjack-style game refers not only to the basic Blackjack game with its variations but also the aforementioned and other games which are like Blackjack.

Other variations include that described in Le Vasseur U.S. Pat. No. 5,257,789 where a player can play a single hand against multiple dealer's hands and String U.S. Pat. No. 5,649,705 where a player can elect to wager upon whether the player or dealer will obtain a winning hand.

These Blackjack games are banked by the house (e.g. casino). This means that the player is playing against the dealer who represents the house. Wagers are paid to a player having a winning outcome by the dealer (the "house") and losing wagers are collected by the dealer for the house. Further nearly all winning outcomes are paid at even money, i.e. 1:1, except for a Blackjack (an Ace with a ten value card) which typically pays 3:2.

In contrast to Blackjack, the game of Poker and its variations is a contest between the players with the highest ranking hand winning the pooled wagers (often referred to as the "pot"), less a levy or "rake" taken by the house dealer for hosting the game. Unlike Blackjack the game of Poker generates social interplay in the form of friendly or not so friendly rivalry, humor, banter and byplay between the players which contributes to the excitement of the game. Furthermore; Poker provides exciting features including providing, in some establishments, what are referred to as "bad beat" jackpots. These jackpots are funded as a levy on the Poker pot and are won by a player who loses but has a predetermined holding, i.e. four-of-a-kind. Since games such as Blackjack and Baccarat do not have player versus player competition, there has been no consideration of providing bad beat jackpots in those games.

Baccarat is a game akin to Blackjack in that the house collects and pays all wagers, i.e. the player is playing against the house, and the object of the game is to obtain a final hand having a value, as determined by the rules of the game, closest to a target value. In Blackjack, the target value is 21 whereas in Baccarat the values are determined modulo ten and the target value is 9.

The rules of play of conventional Baccarat are well known including the complicated and cumbersome rules governing when a third card is dealt to either the Banker or the Player hands. Suffice it to say, players play the game by wagering that either the surrogate Banker hand or Player hand will have a total, modulo ten, closer to nine than the opposing hand. Players may also wager that the Banker and Player hand will have an equal total (a tie). In that the third card draw rules provide a statistical advantage to the Banker hand, the house exacts a commission upon winning Banker hand wagers of typically five percent. No commission is exacted upon winning Player hand wagers. As stated above, the rules of Baccarat are well known in the art.

A drawback of conventional Baccarat is that the house must keep track of and assess commissions on winning, Banker hand, wagers. A further drawback is that the third card draw rules are complex and difficult for novice players to understand. The third card draw rules are strict leaving the players with no opportunity to use strategy or hunches to opt to obtain or not obtain a third card. Yet another drawback is that the players play to the surrogate Banker or Player hands and thus cannot rely on their own individual luck. Further, in conventional Baccarat the players have only one opportunity to receive a payoff, e.g. a winning wager on one of the Banker or Player hands or winning the tie bet. It would be advantageous to provide players with opportunities to receive a payoff even if they do not win the Banker-Player contest or the tie wager.

It is an object of the method of the present invention to inject the excitement associated with Poker into the game of Blackjack or Baccarat.

It is a further object of the method of the present invention to increase the revenue received by the casino for Blackjack or Baccarat.

It is further an object to provide the players with additional opportunities to receive a payoff while playing the game.

A Poker related game is as described in my U.S. Pat. No. 5,975,529 (the '529 patent) the disclosure of which is hereby incorporated by reference. In this game the players make two wagers, one against the house and a pot wager to be resolved against the players. A predetermined number of cards are dealt, e.g. three cards to each player and two community cards. From the community and two player cards, each player forms a five card Poker hand. Wagers are resolved by comparing the rankings of player hands, inter se and to a predetermined pay schedule. A drawback of this game is that to fund jackpots or the hosting of the game, the casino may have to exact a levy on the aggregated pot wagers.

It is another object to provide a variation to the game of my prior patent which dispenses with the need for a levy.

There is also a casino poker game known as CARIBBEAN STUD® which is as described in U.S. Pat. No. 4,836,553 issued Jun. 6, 1989 to Suttle et al., the disclosure of which is incorporated by reference. In this game a player makes an ante wager and five cards are dealt to each player and to the dealer, four of the five dealer's cards dealt face down. To continue play the player makes an additional wager and the dealer reveals his hand. If the dealer's hand does not qualify by having at least an Ace-King, the player wins even money on their ante wager and their second wager is returned. If the dealer does qualify, the dealer's hand is compared to the player's hand with the higher Poker ranked hand declared the winner. If the player's hand has one of a schedule of holdings, the player also receives a bonus payout.

In Breeding U.S. Pat. No. 5,288,081 issued Feb. 22, 1994, the disclosure of which is hereby incorporated by reference, another Poker game known as LET IT RIDE® is described. In this game the player makes initially three separate wagers and three cards are dealt to the player and two community cards are dealt face down. Based upon the player's three cards, they may leave or withdraw one of their wagers. The dealer then reveals one of the community cards and the player again has the option of leaving or withdrawing another one of their wagers. The dealer then reveals the second face down card and resolves the player's hand against a predetermined schedule of winning outcomes.

In both LET IT RIDE® and CARIBBEAN STUD® games it has been known to provide for an optional jackpot wager which is paid to the player based upon a predetermined schedule of jackpot hands.

It is to be noted that insofar as Blackjack, Baccarat, the game according to the '529 patent and other games such as Pai Gow, Let It Ride®, Caribbean Stud® and the like, either the player competes against a dealer hand or there are dealt community or communal cards used by all players to form their hand.

Further in my prior application I disclose using a levy on the pot component of the games, which I have introduced, to fund the hosting of the game as well as jackpots.

It is another object of the present invention to provide a game which dispenses with the need to exact a levy on player's winnings and which still provides a mechanism for the casino to make a profit.

SUMMARY OF THE INVENTION

There is provided, therefore, according to the present invention an improved method for playing a modified casino game of type wherein each player makes a first wager to participate in the game such as a game which has basic play rules, e.g Blackjack, Baccarat (Baccarat, Chemin de Fer), Let It Ride, Caribbean Stud or the like and where each player makes a second, pot, wager. The pot wagers are aggregated to form a pot. Cards are dealt according to the rules of the game, including cards dealt to form a dealer hand or communal cards. If the initial deal to the dealer/community are of a predetermined holding, the house wins the pot. If not, the games are played to their completion with one or more players winning the pots and/or obtaining winning outcome combinations.

By providing for certain house (casino) winning hands, the casino can dispense with the need to exact a levy. The house-potwinning hands are selected to provide the desired vigourish to the house. For example, the combination of Ace-King may be selected or Ace-King or Queen. Accordingly, if the dealer/Banker hand re the first two cards dealt/exposed are an Ace-King or Ace-King or Ace-Queen, the pot is won by the house.

Blackjack/Baccarat Style Games and Pai Gow

According to this embodiment, the player and the dealer (Banker for Baccarat) are dealt a hand of cards from the values of which are summed according to the rules of the game. In a Blackjack-style game, the cards are summed with picture cards, i.e. Jacks, Queens and Kings, having value of ten, Aces having a value of one or eleven and all other cards having a their face value. For a Baccarat-style game, the picture cards have a value of zero, Aces a value of one, the other cards have their face values and the cards are summed modulo ten. The player's first wager is won or lost in comparison to the dealer's hand. As between the player and dealer, the hand with the highest summed value closest to a target value (21 for Blackjack and 9 for Baccarat) is declared the winner with ties deemed pushes. If the player is the winner, he is paid usually 1:1 based upon his first wager. If the dealer is the winner, the player's first wager is collected.

The method of the present invention includes each player making the second, pot wager, the pot wagers aggregated to form a pot. The player of the hand with the highest value hand as between the players closest to the target value is awarded at least a portion of the pot. Players having the same, highest values, share in the award. Alternatively, the pot is carried over to the next round of play. An additional levy may be assessed on the pot and used to fund a jackpot paid to players having a predetermined hand card combination and/or used to fund an alternate or additional bad beat jackpot awarded to a player who loses the pot and who has predetermined holding of cards, certain dealer hand combinations such as for Blackjack the dealer receiving as his first two cards, an Ace-King, or for Baccarat the Banker's hand being Ace-8.

For Pai Gow, the players make a second, pot wager, said pot wagers aggregated to form a pot. The player's first wager is resolved according to the rules of Pai Gow. The pot is won by the player having the highest ranking two card, low hand from their seven cards or the highest ranking five card, high hand. To avoid exacting a levy on the pot Pai Gow, certain dealer hand combinations are deemed automatic house wins and the house wins the pot wagers. The card combinations may be Ace-King, or the like, re the dealer's first two cards dealt/exposed, the frequency of which is selected to provide the required vigourish to the casino so that a levy need not be exacted on the pot.

The above feature of providing for certain automatic house wins to avoid exacting a levy can also be employed in traditional Pai Gow (no pot bets) so that the house does not need to exact a commission on player winning hands.

Let It Ride/Carribean Stud

There is therefor provided according to the present invention a method for playing an improved game of CARIBBEAN STUD® or LET IT RIDE® which includes the players making the required wagers to play the underlying game of CARIBBEAN STUD® or LET IT RIDE® according to the rules therefor as well as an additional, mandatory, pot wager. The players pot wagers are combined and assembled to define the pot. The underlying game is played according to its rules with wagers collected and awarded as defined by those rules. According to the improvement of the present invention, the pot wagers are resolved by comparing the players' hands and awarding the pot to the player(s) having the highest ranking hands according to the ranking of hands of Poker. Where several players have equal, highest ranking hands, the pot is divided among those players or carried over to the next round of play.

In lieu of exacting a levy on the pot to provide a profit to the casino for hosting of the game, certain community card combinations dealt during play are designated as house—pot winning hands. For example, if the community cards include an Ace with a King or Queen, the house would win and collect the pot in lieu of exacting a levy on the pot.

For Caribbean Stud, where a pot is provided, instead of exacting a levy on the pot as a house vigorish, certain dealer hand holdings are designated as pot winning hands, e.g. where the dealer's first two cards dealt/exposed are an Ace with a King or Queen.

The '529 Patent/Poker

In lieu of exacting a levy on the pot, certain community hand holdings may be designated as house—pot winning hands where the house wins the then constituted amount of the pot. In this fashion the house's profit would be funded by the house occasionally winning the pot.

System

Also set forth is a system for playing the games according to the present invention. The system includes a host processor which is linked to a plurality of gaming terminals which can be dedicated gaming machines, personal computers or the like. Each player at one of the terminals make a wager to play the game as well as the pot wager to play against the other players linked through the host processor. The processor determines which players win their games as well as determining the winner(s) of the aggregated pot wagers. Where the virtual dealer for the linked machines has a predetermined holding, the house wins the pot thereby eliminating the need to exact a commission or levy on the pot.

BRIEF DESCRIPTION OF THE DRAWINGS

These and other features and advantages of the present invention will become appreciated as the same becomes better understood with reference to the specification, claims and drawings wherein:

DESCRIPTION

Broadly, the present invention is directed to a base game where each player makes a wager and playing cards are dealt and summed according to the rules of the game. While the description herein is directed by way of example to Blackjack-style game and in another aspect to Baccarat style games, it is to be understood that the concepts, description and claims as recited herein apply to other games such as Poker, Let it Ride, Caribbean Stud, Pai Gow and the like. The variations are below, separately described.

Blackjack-style Games

The present invention comprises a method for playing such a Blackjack-type wagering game which utilizes at least one deck of playing cards. While the present Blackjack-type wagering game will be described for use at a gaming table with one or more players, it should be noted that the game can be adapted to be played on an electronic or video gaming machine with multiple player stations all playing against a single dealer and all players competing between one another for a pot of pooled wagers or in a live or virtual format presented over the Internet.

Figure 1:
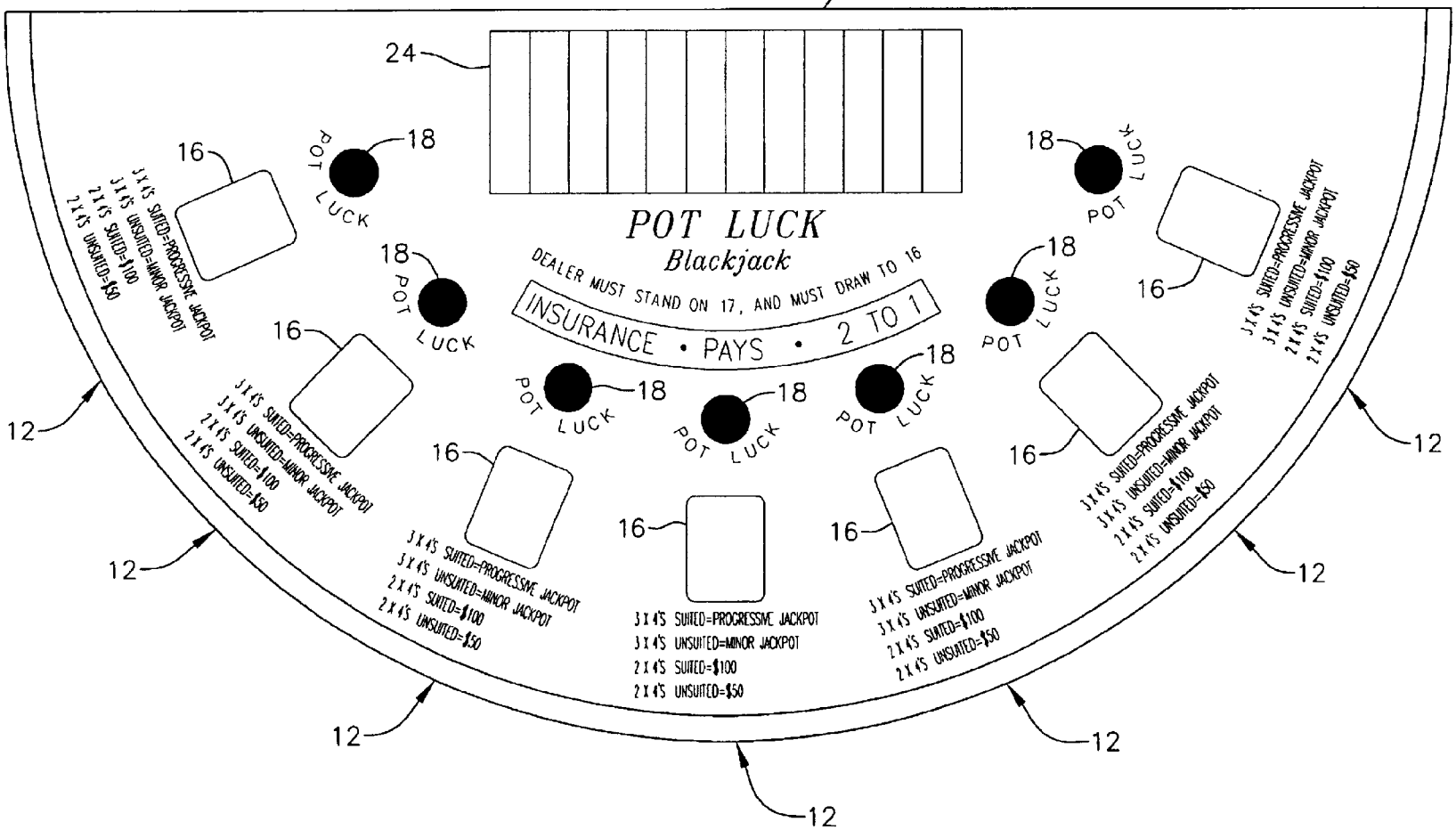
FIG. 1 shows an example of a layout for the play of a Blackjack-style game according to the present method.

Referring to FIG. 1, a table layout 10, upon which the modified Blackjack game of the present invention is played, is schematically shown. The layout is preferably mounted on top of a conventional type gaming table (not shown). A plurality of playing locations 12 are provided along the periphery of the table. Typically, there are seven playing locations. Each of the playing locations has the following designated areas associated therewith betting areas 16 and 18. A dealer's location 22 is provided and has a chip rack 24 to contain the chips paid and collected during the play of the game.

A round of the modified Blackjack game of the present invention is begun by each player placing first and second wagers, the first wager placed in the betting area 16 and the second wager in the betting area 18 respectively. The wager on the betting area 16 constitutes the traditional wager associated with the game of Blackjack, namely, a house banked contest between each player's hand and the dealer's hand. The wager on the betting area 18 constitutes a feature found in the modified method of play of the present invention, namely, the pot bet.

The second wagers placed in areas 18 may be combined by the dealer into a pot accumulated at the center of the table.

Once the players have placed their first and second wagers the dealer deals two cards to each of the players and to the dealer. The round or hand of Blackjack then proceeds in a manner known in the art and according to the rules of the game. After the initial deal, the dealer first settles with each player separately with regard to their wagers on the betting areas 16. Each player in turn, may either "stand" (on his first two cards, or at any later time), or may request additional card(s). A player may continue to draw additional cards, but once he stands he may draw no more cards. All additional cards received by the player are usually dealt face up. If an additional card puts the player's hand count over 21, he must show his cards and the dealer collects his first and second wagers. This player has busted and is no longer in the hand. When every player, except the dealer, has either completed their hand to a final holding represent a final count not exceeding twenty-one or busted and dropped from the hand, the dealer turns up his face-down card. Casino rules may specify that the dealer must take additional cards as long as his total is 16 or less and must stand when his total reaches 17 or more. If the dealer goes over 21 he loses the hand and pays each player remaining in the hand. When the dealer completes his hand, he collects from each player having a lower count, pays each player having a higher count, and has a stand-off (push or draw) with each player having the same count.

Under the rules of Blackjack, a player has the option regarding his wager on the betting area 16, if his first two cards are a pair, such as two sevens or two Jacks, to play them as two different hands. When the player who 'split' turn comes, he turns both cards face up and places another wager in the amount of his first wager on betting area 16 and an additional second wager in area 18 for each split hand. The player then plays and completes each of his hands separately.

All of the conventional features of the Blackjack-style game as they apply to the wager on the betting area 16 may be utilized by the player in the method of the present invention. A player may 'double down' and take 'insurance' on his hand as the conventional manner of play according to what the rules will permit.

Having settled all bets in relation to the first wagers placed in the betting areas 16 for Blackjack the dealer then once again examines each player's hand in relation to the second wagers. Those players who busted are no longer in the hand and do not qualify for the pot accumulated from the second wagers. Players that 'split' their cards into two hands qualify for the pot/pooled wagers in terms of both hands. Alternatively, only one of the hands, e.g. the first hand qualifies for the pot/pooled wagered. The dealer determines which player(s) has a count of 21 or alternatively which of the players has the highest count closest to 21 and awards all the aggregated second wagers representing the pot to such player less a levy or vigorish (often referred to as a "rake"). In the event of two or more players hold the highest count, the pot is shared on an equal basis or alternatively carried over to the next hand. In the event of all players 'busting,' having a total in excess of 21, a levy is deducted from the winnings and the remainder of the winnings are carried forward to the next hand.

In a preferred embodiment of the modified method of playing the game, the second wagers placed in the betting areas 18 are combined with a jackpot feature. The jackpot paytable is comprised of a series of ranked hands with an ascending order of fixed odds or alternatively the jackpot will be a progressive jackpot. In the latter case the major jackpot will be represented by the current total displayed on a win meter and the minor jackpots a combination of a percentage of the major jackpot total and fixed amounts. The betting areas 18 are drawn onto the playing surface/layout 10 or may be defined by sensors which are either magnetic, or fitted with optical eyes or capacitors to determine the placing of wagers. Table A as illustrated below is a specimen paytable of a jackpot feature to be combined with the pot bets in the betting areas 18.

TABLE A

| | |
|---|---|
| Three suited 4s | Progressive Jackpot |
| Three unsuited 4s | 50% of Jackpot |
| Two suited 4s | 25% of Jackpot |
| Two unsuited 4s | 10% of Jackpot |

Alternatively, the awards could be fixed amounts such as suggested in Table B below.

TABLE B

| | |
|---|---|
| Three suited 4s | $15,000 |
| Three unsuited 4s | $10,000 |
| Two suited 4s | $5000 |
| Two unsuited 4s | $500 |

Figure 2:
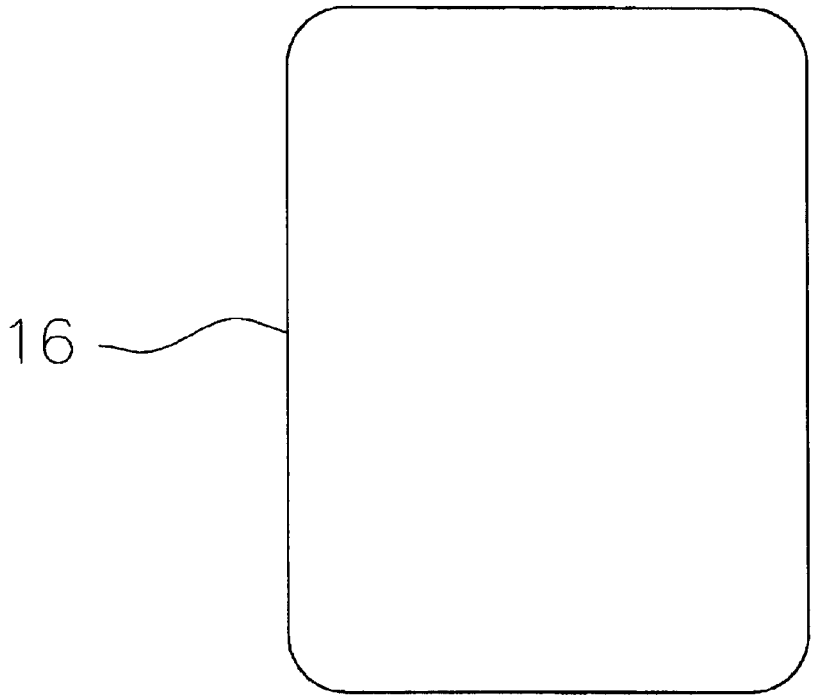
FIG. 2 shows an enlarged view of one of the player's betting areas of FIG. 1 with certain payoffs listed therefor.

FIG. 2 illustrates an enlarged view of the betting area 16 which may have indicated adjacent thereto the various jackpot combinations and the payoffs for each.

To provide a profit on the pot wagers without exacting a levy according to the present invention, certain dealer (house) hands are designated as hands or card combinations wherein the pot is won by the dealer to the exclusion of the players. For example, if the dealer's first two cards dealt are comprised of an Ace-King combination, the dealer (house) would win the pot. It is believed that the frequency at which the house will win the pot provides a 1.2% vigourish to the casino which can be used to profit the to the casino in lieu of a levy. Other combinations or a plurality of combinations can be selected to increase or decrease the vigourish.

A player remaining in the hand (he has not previously busted) who has a predetermined jackpot holding such as those set forth in Table A is awarded the corresponding jackpot regardless of whether or not he wins the Blackjack first wager or the pot bet. All wagers and awards are separately determined. In accordance with the method of the present invention a player may lose both first and second wagers yet qualify for a payout on the jackpot feature.

It is to be understood that the jackpot holdings and payouts of Tables A and B are suggestive only in that the casino may adopt different holdings and payouts.

As a further embodiment, the second wagers accumulated to form the pot could be awarded based upon (i) the highest count of the first two cards or (ii) the player(s) having a Blackjack.

As yet a further embodiment, a separate jackpot wager could be made in addition to the first and second wagers. Thus a player, under this embodiment, would be required to make a first wager to participate in the basic Blackjack game, a second wager to form the inter-player pot and a separate jackpot wager directed to the jackpot component of the game. The automatic, dealer pot winning hands could then be used to simply provide the profit to the casino, with the jackpot being funded from the separate jackpot wagers. To accommodate the three separate wagers, three areas would be denoted on the layout therefor.

As a further feature a portion of the jackpot may be allocated to fund a bad beat or a big beat jackpot. A bad beat jackpot award would occur If a player loses the pot to a player having a higher value hand and the losing player has a predetermined holding of cards. In a bad beat condition, the pot losing player would be awarded at least a portion of the jackpot. Additionally the player having the higher valued hand may be awarded a portion of the jackpot as well as awarding a portion of the jackpot to the other players at the table.

As but an example, a bad beat jackpot may be provided where the pot winning player has a non-suited Ace-10 and the losing player has a hand of 10-10 of Spades. In this occurrence, the losing player would be awarded 50% of the assembled bad beatjackpot, the winning player with the non-suited A-10 awarded 25% of the jackpot and the other players playing that hand at the table awarded on a pro rata basis the remaining 25% of the jackpot. Other combinations may be provided for a bad beat award as well as providing a different schedule of pay outs.

A big beat is the converse to a bad beat. In this case the player who won, e.g. the player with the non-suited Ace-10, would be awarded the larger percentage of the jackpot with the loser having the qualifying holding, e.g. 10-10 of Spades, receiving the smaller portion.

Baccarat-style Games.

Figure 3:
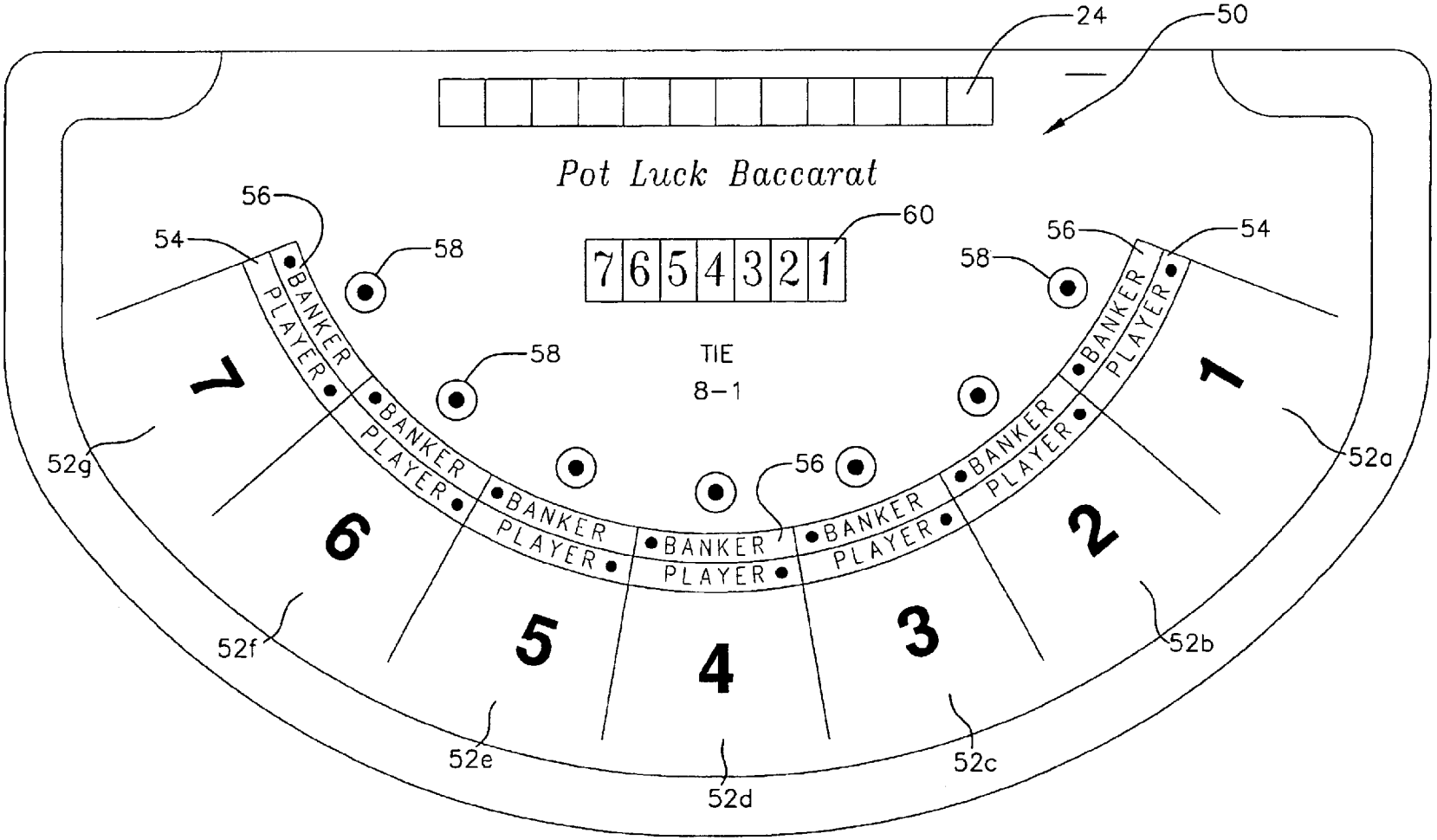
FIG. 3 shows an example of a layout for the play of a Baccarat-style game according to the present invention.

With reference to FIG. 3 the method of the present invention will be described in connection with a Baccarat-style game. While the present method will be described for use at a gaming table with one or more players, it should be noted that the game can be adapted to be played on an electronic or video gaming machine or over the Internet, with multiple player stations all playing against a single dealer and all players competing between one another for a pot of pooled wagers.

To play the game each player makes a first ante wager on either a Player hand or a Banker hand to be presented during play of the game. For this purpose, a layout 50 may be provided including a plurality or, for example seven, player positions 52*a–g*. At each position 52*a–g* there is provided a number of wagering areas adapted to accept wagers made by the player. A Player area 54 is provided at each position 52*a–g* in which the player may place the first ante wager to indicate that he is wagering upon the Player hand controlled by the player. Similarly there is a Banker area 56 in which a player may place their first ante wager to indicate that the player is wagering upon the Banker hand controlled by the dealer. Also each position 52*a–g* has associated therewith a pot wager area 58 in which the player places their second ante, or pot, wager according to the present invention. The pot wager area 58 may include sensors to register acceptance of the mandatory pot wager by each player. Also provided on the layout is a tie wager area 60 denoting each player position 52*a–g* as by being numbered one through seven. A check rack 24 is provided to contain chips used during the play of the game.

To play the game according to this embodiment, each player places their first ante wager in one of the Player or Banker areas 54,56 to signify which hand (Banker or Player) the player is wagering upon. The amount wagered may be dictated by table minimums or maximums. The player is also required to place a second ante (pot) wager in the pot wager area 58. The amount of the second ante wager may also be dictated by table minimums or maximums and the amounts wagered by the players as their second ante wagers will typically be the same for each player, e.g. five dollars. After the players have made their second ante wagers, the wagers are collected into a pot on the table. Each player also has the option, should they so desire, to place a tie bet by passing the amount of the tie wager to the dealer who places the tie wager in the corresponding player position in the tie wager area 60. Thus if the player at position 7 places a tie wager, that wager would be placed in the position denoted as "7" in the tie wager area 60 to signify this wager.

After the players have each made their first and second ante wagers and any optional tie wager, the dealer for the game deals two cards to each player as that player's Player hand and two cards in the middle of the layout 50 designated as the Banker hand. The cards are typically dealt from a shoe containing a plurality of standard decks of playing cards as, for example, six decks. The player Hand cards may be dealt face up with none, both or one of the Dealer's hand cards dealt face up. Each player values the cards of their hand, modulo ten, according to the rules of conventional Baccarat. Alternatively the face cards can have a value of ten and Aces count as one or eleven which, because the hands are summed modulo ten, will obtain the same hand valuations as in conventional Baccarat. The dealer also examines the value of the initial two cards of the Banker hand. If the value is eight or nine, the dealer exposes the Banker hand and the players may not draw any third cards to their hands and all wagers are resolved as described below.

If the Banker's hand does not have a two card value of 8 or 9, the player's assess their Player's hands. If the Player's hand value is 0–6, a third card is dealt to the Player hand. Alternatively, the player may opt to receive a third card. If the Player's hand has a value of 7–9, no third card may be received and the two card value is the Player hand final value. If a third card is dealt or the player opts to take a third card, that card's value is added to the two initial cards, modulo ten, to obtain a final Player hand value. After all player's have completed their respective Player hands, the dealer exposes the Banker hand. If the value of the Banker's hand is 7–9, the dealer may not deal a third card to the Banker hand and the two card values becomes the final Banker hand value. If the Banker hand initial two cards have a value of 0–6, the dealer deals a third card to the Banker hand, the value of which is added to the initial two cards (modulo ten) to arrive at a final Banker hand value. Thus the third card draw rules are easy to understand and symmetrical with respect to the Banker and Player hands. In one embodiment, where either a Player hand or the Banker hand has an initial value of 0–6, draw of a third card is required. In another embodiment, the player is provided with the option of drawing or not drawing a third card. It is to be understood that these third card draw rules may be modified to only be in effect when the initial values of the hands are 0–5.

In still a further embodiment, rather than applying the third card draw rules at all times to the Banker hand, where any Player hand has an initial value of 8 or 9 (a Natural in Baccarat), the Banker as to this Player hand value is precluded from drawing a third card. Thus if a Player hand has an initial value of 8 or 9, the dealer when he first exposes the Banker hand of the initial two cards would resolve that Player hand before drawing any third cards if required. After resolution of any Natural Player hand(s), the dealer would deal a third card to the Banker hand if required and thereafter resolve the remaining Player hands.

Each player's first wager is resolved in order by comparing the Banker's hand final value to each of the player's individual Player hand values. If the Banker hand has a highervalue than that player's Player hand, e.g. is closer to the target value of 9, the highest value which can be obtained, the Banker hand is the winner. Conversely if the player's Player hand has a higher final value than that of the Banker, the Player hand is the winner. Hands of the same values are ties.

Once as to each player it is determined which of the Player or Banker hands is the winner (or a tie occurs), the dealer determines which hand the player wagered upon with his first wager. If a player has wagered upon the Banker hand and the Banker hand is the winner that player is paid 1:1 based upon his first wager. If the player has wagered upon the Banker hand and the Player hand is the winner, the player loses his first wager. Conversely, if the player has wagered upon the Player hand and the Player hand is the winner the player is paid 1:1 for his first wager. If the player has wagered upon the Player hand and the Banker hand is the winner, the player loses his first wager. If for any player his Player hand ties with the Banker hand, there is no action regarding the player's first ante wager, i.e. the first wager is neither won not lost. If the tying player has made a tie wager, the player wins the tie wager and is paid 8:1 on the tie wager.

Regarding ties, to provide a vigourish to the casino, certain tie wagers may be deemed losers. For example, ties at 1 or 2 would be declared losers for the player's first ante wagers regardless of whether they wagered upon the Banker or the Player hand. This provides the casino with a vigourish for the basic game of about 1.18%. Other losing tie value(s) may be selected. By making a tie wager a player may insure winning even in the event of a tie at a losing value.

After the players' first ante wagers have been decided, collected and paid, the second ante wagers are resolved. The aggregated pot of the second ante wagers is paid to the player or players having the highest Player hand values. For example, if the highest Player hand value is 6, that player would be awarded the pot regardless of whether or not the player won his first ante wager. The awarding of the pot is independent of whether or not the player wins the first ante wager thereby giving the player an opportunity to win even though he lost his first ante wager.

To provide a profit to the casino and to dispense with the need to extract a commission, the present invention includes designating certain Banker hand combinations as winning the aggregated pot. For example, if the Banker's hand first two cards are an Ace-8, the house (Banker) would win the pot to the exclusion of the players. By providing for occasional pot wins for the house, a suitable vigourish can be maintained.

A progressive jackpot may be funded by exacting a set proportion of the individual pot bets and may award a portion of the jackpot to any player having a predetermined Player hand holding. The jackpot or a portion of which may be awarded, for example, to any player having a Player hand with any one of the following holdings, again regardless of whether or not the player has won the first ante wager or the second ante wager aggregate pot, Jackpot Holdings Three 3s Three 3s (same suit)

Three 3s (spades)

Three of a Kind

Three of a Kind (same suit)

Three of a Kind (spades)

Ace, Ace, 7 (same suit)

Ace, Ace 7 (spades)

Other jackpot holdings may be provided. If a player has a Player hand with a jackpot holding, he would be paid the corresponding jackpot payoff represented by a fixed amount or a percentage of the pot funded aggregate jackpot.

Additionally or alternatively the occasional winning of the pot by the house will ensure a profit on the pot separate and distinct from the portion of the pot wagers which may be used to fund a bad beat or a big beat jackpot. As but an example, a bad beat jackpot could be awarded where a player having a Player hand of a first ranking loses the pot to a player having a Player hand with a second ranking. For example, the second ranking may be preselected as a two card Natural (a hand value of 9) of an unsuited 3 and 6 and the losing player second ranking is a two card hand of two 9s of Spades. In that event, the losing player would be awarded 50% of the progressively accumulated bad beat jackpot, the winning player 25% and all other players at the table who had participated in the round of play 25% of the jackpot on a pro rata basis. Conversely, for a big beat jackpot, the winning player with the unsuited 3 and 6 would be awarded the larger portion of the jackpot.

Like the Blackjack game described above, the jackpots for the Baccarat-style game may be funded by a separate, third, side wager such that the house winning of the pots can be used to increase the profit to the casino.

For Caribbean Stud/Let It Ride/Pai Gow

With this game, the present invention includes, in addition to the wagers made according to its method of play described above, each player making a pot wager, the pot wagers accumulated into a pot. As described below, the player at the table, regardless of whether they win any of the Caribbean Stud game wagers, still has the opportunity to win the pot by having the highest ranking Poker hand among the players at the table.

To play the game each player makes their Caribbean Stud outcome wager(s) according to the rules of the game. Additionally, according to the present invention, each player makes a pot wager to compete against the other players at the table for the best hand.

With respect to the pot wagers, the player with the highest Poker hand showing wins the aggregated pot wagers. The pot wagers are a bet solely between the players and do not involve a wager against or to be paid by the house (casino).

At the start of each game and prior to receiving cards all players make their pot and game outcome wagers. Cards are then dealt according to the rules of the game and the outcome wagers are resolved, also according to the rules of the game.

In addition to any jackpots provided according to the known rules of play, any jackpot to be paid to a player for obtaining a specific outcome, e.g. a Royal Flush, any bad beat or big beat jackpot or simply to increase the profit for the casino, the present invention includes designating certain dealer hand card combinations as hands where the house (dealer) wins the pot to the exclusion of the players. By providing an occasional house win of the pot, a vigourish can be set to provide additional profit to the casino. For example, if the dealer's first to cards dealt for his Caribbean Stud hand has an Ace-King combination and that is deemed a pot winning combination for the house, it is believed that the house will have a vigourish of an additional 1.2% created by the occasional house wins of the pot.

A further embodiment of the present invention, wherein a progressive or fixed jackpot is a feature of the game, is so structured that the jackpot is divided into a primary jackpot with a Royal Flush being the winning combination and a secondary jackpot being awarded in a designated bad beat or big beat situation in the manner suggested above.

After the outcome wagers have been resolved by comparing the player's hands to that of the dealer and by comparing each player's hand to the predetermined pay out schedule, the players' final hands are compared to determine which player has the highest ranking hand. The player having the highest ranking hand is awarded all of the pot wagers made (unless the pot has already been won by the house). Players having equally ranked hands share equally in the award of the pot wagers or, alternatively, the pot is carried over to the next round of play.

Thus it can be seen that the players have multiple opportunities to win and by providing for occasional house wins of the pot, additional profit can be made by the casino.

Pai Gow, like Caribbean Stud, includes a dealer hand. Like the improvement to Caribbean Stud described above, the present invention includes providing for Pai Gow that each player also make a pot wager which is won by the player having the highest ranking five card high and or two card low hand. While normally the house does not participate in the winning, losing or funding of the pot, to provide an additional vigourish and to eliminate the need to collect commissions, certain house hand combinations are deemed hands where the house (dealer) wins the pot. For example, if the Dealer's first two cards dealt include Ace-King, or a low pair, e.g. 2-2, 3-3, 4-4, the house wins the pot.

For Let It Ride, the game is played according to its known version, with each player making three outcome wagers of the same amount, receiving three cards and the dealer dealing two community cards face down. As community cards are revealed the player has the opportunity to withdraw up to two of his outcome wagers. Ultimately, the player's cards are revealed and combined with the community cards to form a five card Poker hand. The hand is compared to a predetermined pay schedule based upon the rankings of Poker hands.

According to the present invention, in addition to each player making outcome wagers according top the rules of the game, each player makes a pot wager, the pot wagers aggregated into a pot. After the game outcome wagers have been resolved, the pot is awarded to the player having the highest ranking Poker hand (using his and the community cards). In the case of ties, the pot is split or carried over to the next hand.

The present invention also contemplates the house exacting a vigourish in relation to the pot to provide additional profit to the casino. According to the present invention, this vigourish is obtained by designating certain community card combinations as pot winning outcomes for the house. For example if the first two revealed community cards are an Ace-King, combination, the house (dealer) would win the pot. The occasional wins of the pot can provide additional revenue to the casino or support a more liberal pay table for the game.

Poker

The method can also apply to Poker games where community cards are dealt and a pot is involved. In addition to the game of Showdown Poker, according to my prior patent described above, this method would apply to traditional Poker where the casino extracts a levy on each pot.

According to the present invention, instead of extracting a levy to fund the game, certain community card combinations or holdings such as the first two community cards dealt (or exposed) can be designating as a pot winning combination for the house when such cards constitute, for example, an Ace-King or Ace-King or Queen. In this fashion, the occasional winning of the pot by the house will provide sufficient vigourish to dispense with the need to exact a levy/commission on the each pot.

As can be appreciated by providing for a pot and by designating certain dealer or community hands as hands which win the pot, the house can increase the profit and/or fund jackpots and/or dispense with the need to extract a levy for the play of the game.

The System

Figure 4:
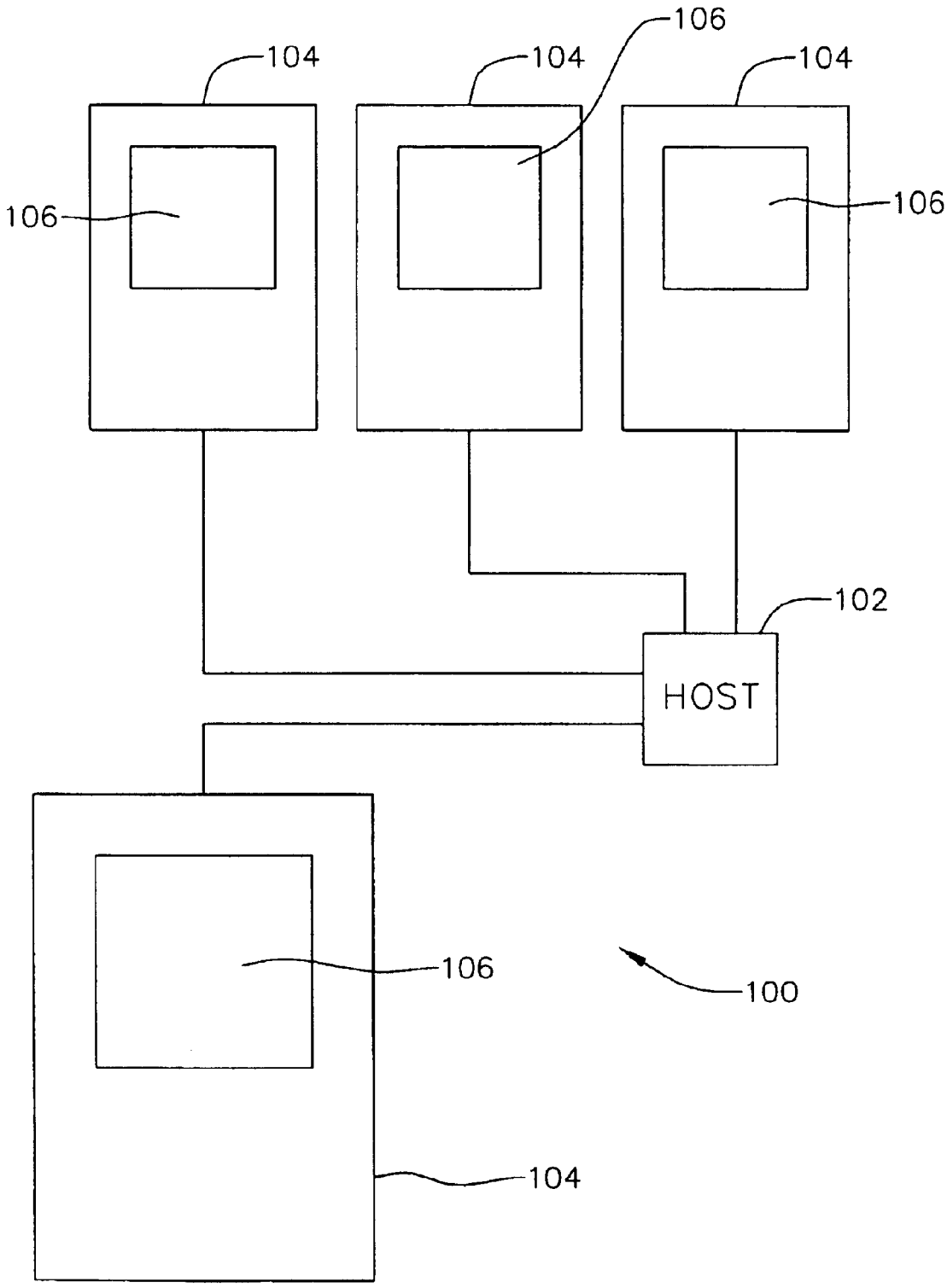
FIG. 4 illustrates a system according to the present invention.

With reference to FIG. 4 a system 100 for the present invention is shown. The system 100 includes a host processor 102 which is linked to a plurality of gaming terminals 104. The link may be by a local area network (LAN), wide area network (WAN), through the Internet or though dedicated wiring. Each terminal 104 may be dedicated gaming machine or a personal computer. Each terminal 104 has a display 106 which is controlled by a terminal processor (not shown).

The game to be played on the system can be any game of the type described above. Each player at their terminal inputs a wager (or wagers as required by the rules of the game) to play the underlying game as well a the pot wager. The pot wagers are aggregated into the pot. The value of the pot may be displayed at each terminal 104 for the player to see. The game is then played in the manner described above with the dealer's hand (or communal cards as the case may be) being commonly displayed at each terminal 104 display 106. Each player at their terminal 104 plays the game according to its rules. Control buttons or a touch screen at each terminal 104 permits players to control play as by discarding, opting to take additional cards, place their wagers as desired and the like. The data concerning wagers and players actions is transmitted to the host processor 102. The host processor 102 controls play by displaying cards or other indicia displayed at each display 106 during play. At the conclusion of the game hand the host processor 102 determines which player has won or lost concerning the game and determines the winner of the pot according to the descriptions of the games above. Regarding the pot wagers, if the dealer hand (or communal cards) has a predetermined holding as described above, the house wins the pot wagers. In this manner the house need not exact a levy or commission on the pot.

It is to be understood that the present invention is subject to many modifications and changes without departing form the spirit and scope of the appended claims. For example, in lieu of cards, dice or Poker dice may be used to provide player hands, dealer hands and communal holdings.

I claim:

1. A method for playing a modified casino game using playing cards or dice wherein each player makes a first wager to participate in the game according to the rules thereof and a second pot wager, said pot wagers aggregated to form a pot and where in addition cards are presented as either a dealer hand or communal holding and where the house exacts a levy on the pot to fund the game and/or a jackpot, said method comprising:

each player making a pot wager, said pot wagers aggregated to form a pot; for each hand, (i) resolving the first wagers according to the rules of the game and (ii) awarding the pot to the player having the highest ranking hand at the table;

designating at least one dealer or community holding as pot winning card combinations; and in the event said cards dealt as dealer/communal holding has a pot winning combination, awarding the pot to the house.

2. The method of claim 1 where the game is Blackjack played with playing cards and including a dealer hand and player hands, further including designating said pot winning combination as a dealer hand of Ace-King.

3. The method of claim 1 wherein the game is Baccarat using playing cards and including a Banker hand and at least one player hand, further including designating a Banker hand of Ace-8 as said pot winning combination.

4. The method of claim 1 wherein the game includes at least a pair of community cards further including designating a community hand are an Ace-King combination as said pot winning combination.

5. A system for playing a modified casino game using playing cards or dice to select player hands and one of a dealer hand or communal holding, the system comprising:

a host processor to control play;

a plurality of game terminals, each including a display, means for a player thereat to input a wager and means for the player to control play according to the rules of the game, said game including a player hand and one of a dealer hand or communal holding;

a communication link between each terminal and the host processor, each player at said terminal inputting a wager to play the game and a pot wager, said pot wagers aggregated to for a pot;

said host processor displaying at each terminal the said one of the dealer hand or communal holding and each player's hand for that terminal; and said host processor determining for each terminal whether the player has won or lost the game hand and comparing all players hand to determine which player has the preselected highest or lowest holding according to the rules of the game and awarding the pot to the player winning player, said host processor awarding the pot to the dealer if the said selected one of the dealer's hand or communal holding has at least one predetermined holding.

* * * * *